United States Patent [19]

Lückert et al.

[11] 4,294,102

[45] Oct. 13, 1981

[54] DEVICE FOR BENDING AND HARDENING BAR MATERIAL

[75] Inventors: Lothar Lückert, Hagen-Emst; Christoph Pohl, Witten; Carl-Erich Proll, Hagen; Paul Steffes, Gevelsberg, all of Fed. Rep. of Germany

[73] Assignee: Proll & Lohmann Betriebs GmbH, Hagen, Fed. Rep. of Germany

[21] Appl. No.: 134,611

[22] Filed: Mar. 27, 1980

[30] Foreign Application Priority Data

Mar. 29, 1979 [DE] Fed. Rep. of Germany ..... 2912364

[51] Int. Cl.[3] ..... B21D 37/04

[52] U.S. Cl. ..... 72/413; 72/446

[58] Field of Search ..... 72/413, 446, 447, 396, 72/397, 455, 128; 29/568

[56] References Cited

U.S. PATENT DOCUMENTS

| | | | |
|---|---|---|---|
| 1,776,082 | 9/1930 | Peterson | 72/413 |
| 1,776,083 | 9/1930 | Peterson | 72/413 |
| 2,783,815 | 3/1957 | Tegarden | 72/413 |
| 3,414,967 | 12/1968 | Erikson | 29/568 |
| 3,858,286 | 1/1975 | Noheji | 29/568 |

*Primary Examiner*—Gene P. Crosby
*Attorney, Agent, or Firm*—Martin A. Farber

[57] ABSTRACT

This invention relates to a device for the bending and-/or distortion-free hardening of bar material, particularly leaf springs, which device has a plurality of frame-shaped tools which upon their closing bend the heated workpiece and lower it in clamped condition into a treatment tank. For the bending and lowering the tools are moved in vertical direction in a portal and discharging from the portal in its lowest position and fed by guide rails of a transport device in a treatment tank. Thereupon the tools are grasped by a lift portal and raised into a position lying above the treatment tank in which position they are opened, the workpiece is removed, and the opened tool is transferred via guide rails of another transport device into a ready position. In order to make a rapid change of tools possible, the upper guide rails for the return of the opened tools can be moved out of their normal position over a part of their length which corresponds at least to the axial depth of a tool and replaced by rail sections which are arranged on a changing device which can be displaced with a tool thereon.

5 Claims, 5 Drawing Figures

DEVICE FOR BENDING AND HARDENING BAR MATERIAL

The present invention relates to a device for the bending and/or distortion-free hardening of bar material, particularly leaf springs, having a plurality of frame-shaped tools each of which consists of an upper part and a lower part, which tools upon closing bend the heated workpiece and lower it in clamped condition into a treatment tank, the tools being moved vertically in a portal for the bending and lowering and discharged from the portal in its lowest position and being moved by guide rails of a transport device through the treatment tank before the tools are grasped by a lift portal and raised into a position lying above the treatment tank in which position the tool is opened, the workpiece is removed, and the opened tool is transferred via guide rails of another transport device into a ready position.

Devices of the type described above are known for the bending and hardening of leaf springs. They have a changing device by which, in each case a tool is lifted upward, displaced laterally, lowered, and replaced by a new tool. This replacement can take place parallel in time with the removal. In this way it is possible to be sure to replace all the approximately 8 to 15 tools of a device in succession by other tools. The normal operating cycle of the device and thus of the entire manufacturing line in which the device is arranged must, however, be interrupted for the duration of the change of the tool.

When the device for the bending and hardening of bar material has a plurality of different tools, as necessary in particular for the manufacture of spring banks consisting of several layers, the known changing devices result in a very lengthy retooling time during which the entire plant is practically at a standstill thus resulting not only in disadvantages as a result of the stoppage of production inherent therein but also because of the fact that the devices arranged in front and behind same must be kept ready for operation for this period of time.

The object of the present invention is to create a device of the aforementioned type for the bending and/or hardening of bar material which avoids the disadvantages of the known devices which have been described above and by which all tools can be changed without additional structural or personnel cost within a very short period of time without having to tolerate substantial standstill times of the device.

This purpose is achieved by the invention in the manner that the upper guide rails for the return of the opened tools can be moved over a part of their length which corresponds at least to the axial depth of a tool out of their normal position and be replaced by rail sections which are arranged on a changing device which can be displaced with a tool thereon.

By this development in accordance with the invention there is obtained a simple and rapid course of movement for the changing of the tools without a lifting of the tool to above the guide rails being necessary so that the changing of a tool can take place within the normal cycle of the tool transport within the device, whereby standstill times resulting from a changing of tools are avoided. Since the lifting, lateral displacement and lowering of a tool to be changed as required in the known devices, which means in each case an acceleration and a deceleration in one of the three directions is replaced by a lateral displacement of the tool in only one direction with a single acceleration and deceleration, the device of the invention can operate with a relatively high speed so that even the changing of individual tools is faster than simultaneously changing several tools, which requires necessarily slower movements due to the high forces resulting from inertia. The changing device of the invention is not only light so that a reinforcing of the base structure can be dispensed with, but it has only two defined end positions, as a result of which easy and accurate positioning is obtained, thus increasing the dependability in operation.

One particularly simple embodiment of the changing device of the invention is obtained if, in accordance with another feature of the invention, this changing device comprises a changing frame which is movable horizontally between a ready position alongside of the treatment tank and a working position above the treatment tank and bears the lengths of rail which replace the guide rails upon a change of tool. These guide rails which can be moved out of the normal position over a part of their length can, in accordance with another feature of the invention, be moved laterally in the direction of motion of the changing frame, one preferred embodiment comprising that at least one of the guide rails arranged above the treatment tank is fastened to the changing frame and moved horizontally with it. In this way the course of operations for the changing of a tool is further simplified.

One embodiment of the device in accordance with the invention is shown diagrammatically in the drawing, in which.

Figure 1:
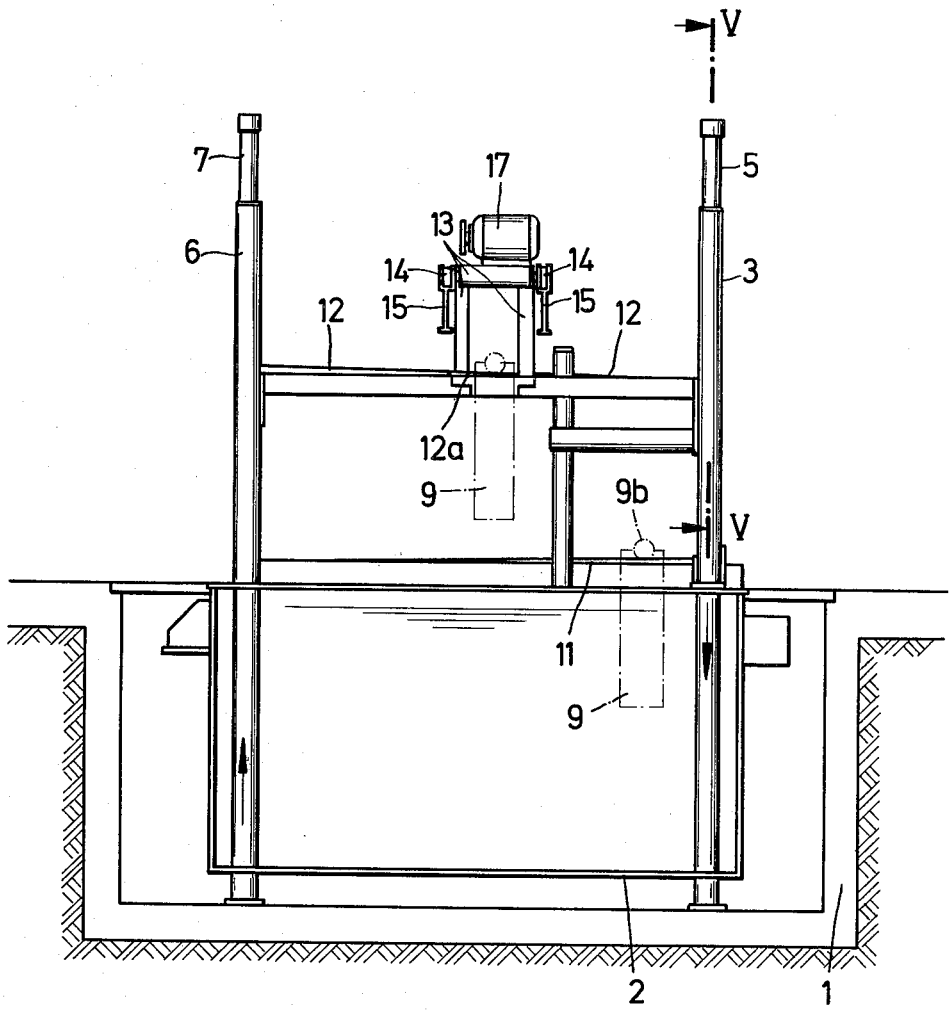
FIG. 1 is a side view of the device.
Figure 2:
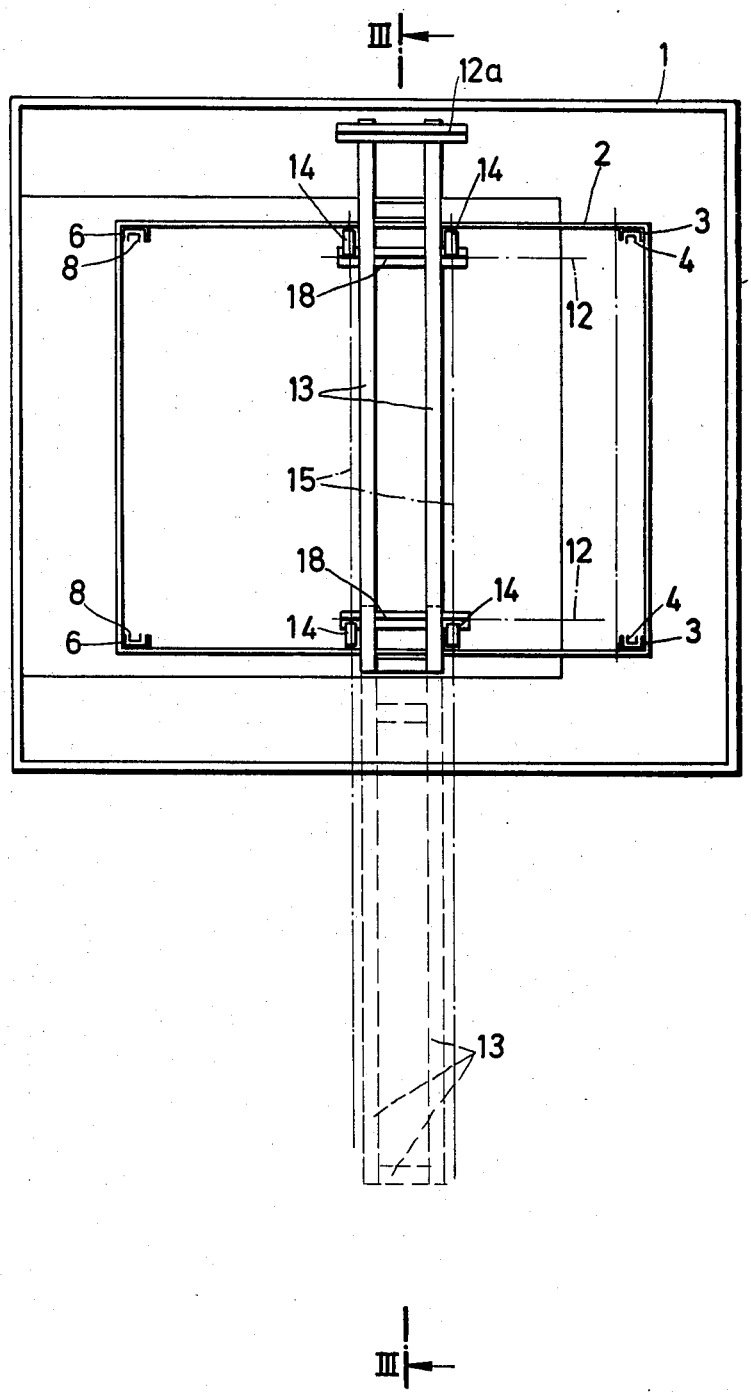
FIG. 2 is a top view of the device shown in FIG. 1.

The device used in the embodiment shown in the drawing for the bending and distortion-free hardening of leaf springs has a treatment tank 2, which is arranged in a foundation pit 1 and in which the hardening process takes place while the workpiece is clamped without distortion. At the front end of the treatment tank 2 there is a front portal 3 in which an immersion frame 4 is movable in vertical direction. The movement of this immersion frame 4 is effected by lift cylinders 5.

Figure 4:
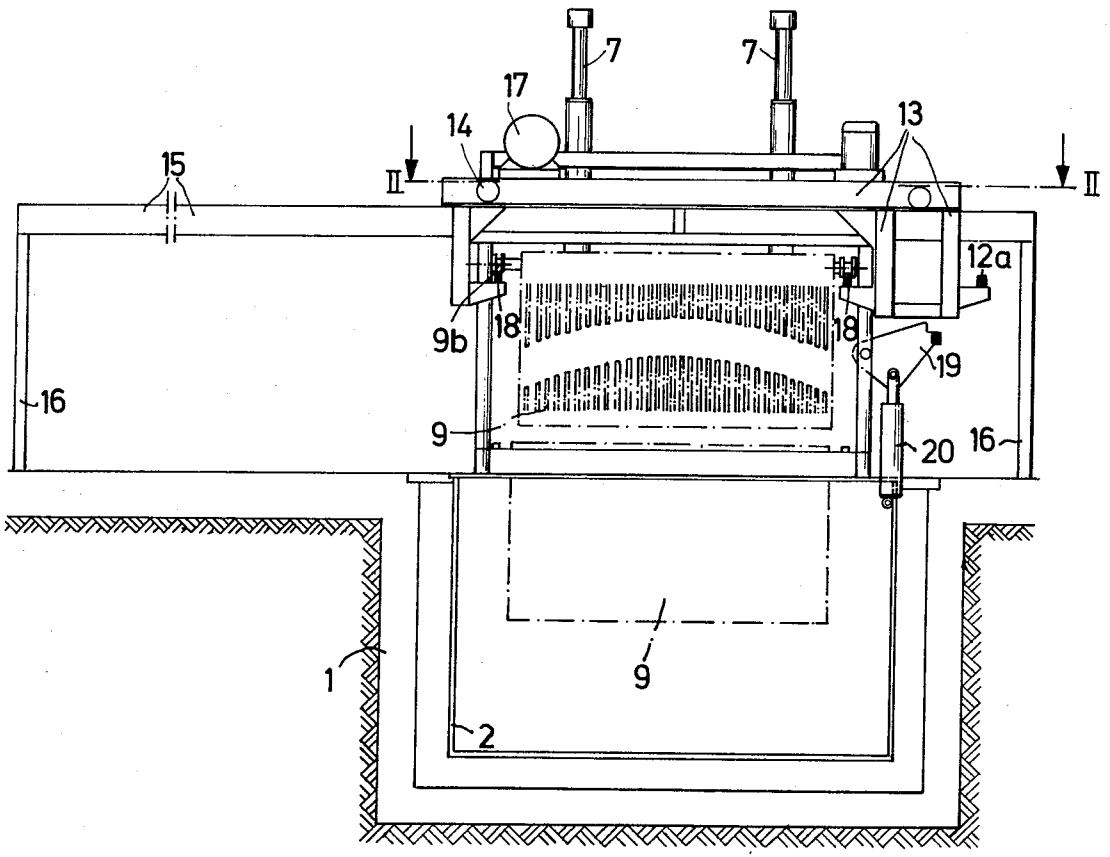
FIG. 4 is a cross section corresponding to FIG. 3 with the tool changed.
Figure 5:
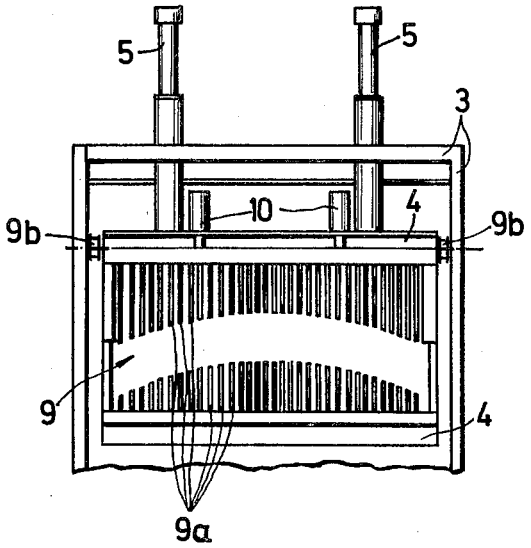
FIG. 5 is a vertical partial section through the device along the section line V—V of FIG. 1.

On the opposite side of the treatment tank 2 there is a rear portal 6 in which a lift frame 8 is movable in vertical direction, also by means of lift cylinders 7. The lift frame 8 is developed in a manner corresponding to the immersion frame 4. Both the immersion frame 4 and the lift frame 8 are intended to receive tools 9 indicated in dot-dash line in FIGS. 1 to 4. FIG. 5 shows a side view of one such tool 9.

Each of these total of eight to fifteen tools 9 has an upper part and a lower part which are provided with adjustable forming pieces 9*a* for the bending and holding fast of the bar stock. This stock is inserted, with the tool 9 open, between the forming pieces 9*a* when the tool 9 is within the immersion frame 4, which is in its upper position. Thereupon, the two tool halves are moved together by means of displacement cylinders 10 arranged on the top of the immersion frame 4. In this way the heated stock is imparted the desired shape. In their brought-together position the two tool halves lock, so that the tool 9 remains, without additional means, in closed condition and holds the curved workpiece fast in clamped position.

After the bending of the workpiece, the immersion frame 4 bearing the clamped tool 8 is lowered within the front portal 3 by the lift cylinders 5 into the treatment tank 2, as indicated by an arrow in FIG. 1. The tool 9 which is provided with lateral supporting rollers 9*b* is discharged in the lowered position from the immersion frame 4 and passes by means of said supporting rollers 9*b*, onto guide rails 11 which are arranged between the front portal 3 and the rear portal 6. These guide rails 11 slope from the front portal 3 towards the rear portal 6, as can be noted in FIG. 1. In this way they form an inclined plane on which the tool 9 slowly rolls from the front portal 3 to the rear portal 6, the workpieces which have been bent into the desired shape being contained within the treatment tank 2 and being subjected to a hardening process.

In the region of the rear portal 6, the tool 9 comes into the opened lift frame 8 with which it is thereupon raised by the lift cylinders 7 into a position in which the entire tool 9 is located above the treatment tank 2. In this raised position the tool 9 is unlocked and opened by means of displacement cylinders which correspond to the displcement cylinders 10 on the immersion frame 4. After the opening, the curved hardened workpieces are removed or ejected from the tool 9. They pass onto conveyor means (not shown in the drawing) by which they are transported out of the device and fed to further operations.

After removal of the workpiece, the opened tool 9 passes by means of its supporting rollers 9*b* onto guide rails 12 which are located above the treatment tank 2 between the rear portal 6 and the front portal 3. These guide rails 12 which lie directly above the guide rails 11 are, in contradistinction to the guide rails 11, inclined from the rear portal 6 in the direction towards the front portal 3. They thus form a sort of inclined plane on which the tools 9 roll from the rear portal 6 to the front portal 3. This can be noted particularly well from FIG. 1. The opened tools 9 thus again pass to the front portal 3 so that they can again be loaded with a workpiece which is to be bent and hardened.

In order to replace the tools 9 present in the device within as short a time as possible by tools which are developed or adjusted for the bending and hardening of other types of workpieces, a changing device is provided with a changing frame 13 which can be moved by means of wheels 14 on supporting rails 15 arranged transversely to the longitudinal direction of the treatment tank 2. These supporting rails 15 are supported by columns 16. The displacement of the changing frame 13 is effected via a drive motor 17 which is arranged on the changing frame 13 and drives, for instance, one or more wheels 14.

Figure 3:
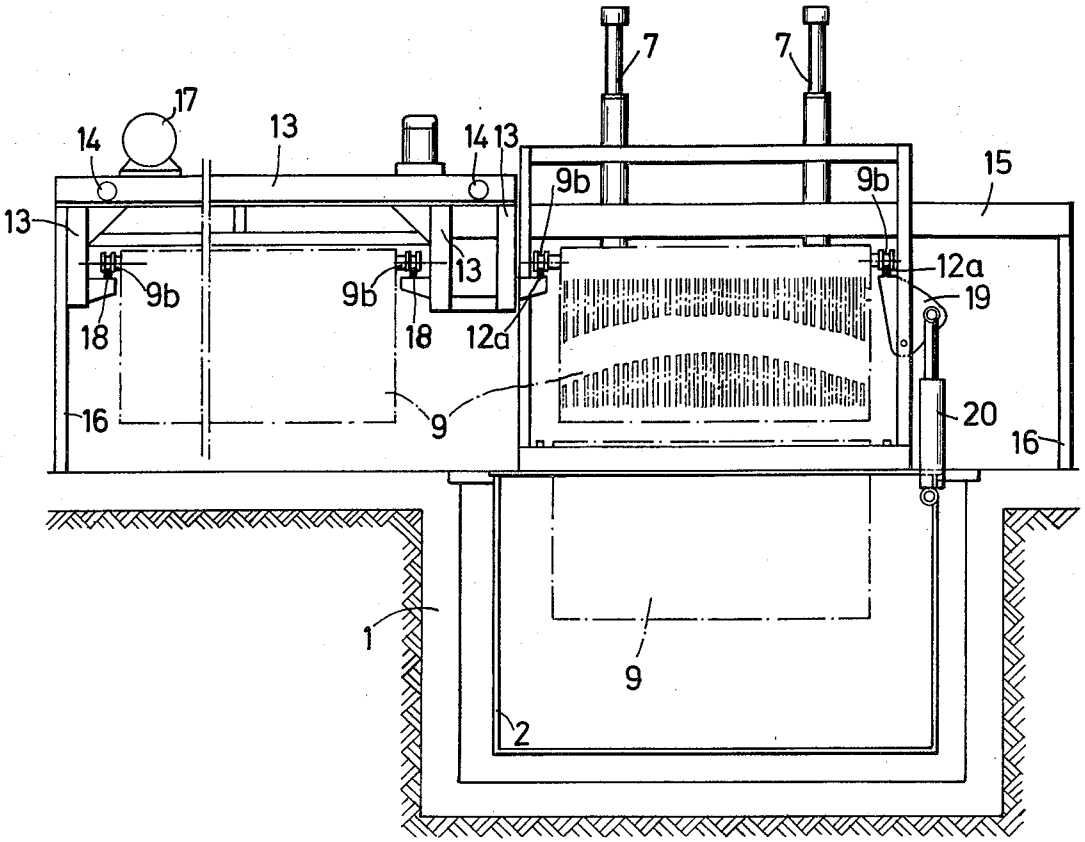
FIG. 3 is a cross section through the device along the section line III—III of FIG. 2 with a tool ready to be changed.

Over a part 12*a* of their length which corresponds at least to the axial depth of a tool 9, the guide rails 12 can be moved out of the normal position. This part 12*a* of the guide rails 12 can be noted with respect to its length dimensions in FIGS. 1 and 2. This part 12*a* of the guide rails 12 is replaced upon a change in tool by rail sections 18 which are arranged on the changing frame 13. These rails sections 18 can be moved together with the changing frame 13 out of a ready position laterally alongside of the treatment tank 2 into an operating position, integrated into the device, above the treatment tank 2. The ready position of the changing frame 13 is shown in FIG. 3 and its working position in FIG. 4.

In order to effect a change of tool, a new tool 9 is placed on the rail lengths 18. Thereupon the changing frame 13 is displaced together with this tool 9 on the supporting rails 15 so that the tool 9 which is to be substituted assumes the position shown in FIG. 4. Upon this lateral displacement of the changing frame 13, the part 12*a* of the guide rail 12 lying to the left in FIGS. 3 and 4 is moved together with the changing frame 13 since it is arranged on it. The part 12*a* of the right-hand guide rail 12 which is movable out of the normal position is arranged on a swing arm 19 which is laterally swingable by means of a swing lever 20 in such a manner that, together with the part 12*a* of the guide rail 12, it passes out of the range of movement of the changing frame 13, as shown in FIG. 4. In FIG. 4 therefore the rail sections 18 replace the parts 12*a* of the guide rails 12 so that the substituted tool 9 can participate in the normal course of movement of the device and a tool 9 which is to be removed from the device comes onto the rail lengths 18 of the changing device. When the changing frame 13 of the changing device is now moved back out of the working position above the treatment tank 2 into its ready position, it carries with it the tool 9 which is to be replaced. The latter can be easily removed in the ready position laterally alongside the treatment tank 2 from rail sections 18 while the normal operation of the device continues on the parts 12*a* of the guide rails 12 which have been moved back again into the working position.

Since the change of a tool 9 takes place exclusively by a lateral displacement thereof by means of the changing device and the operating rhythm of the device is not interrupted in the two end positions of the changing device since either the parts 12*a* of the guide rails 12 or the equivalent rail sections 18 of the changing device are available for the rolling away of the open tool 9, the operation of the device need not be interrupted even upon the change of a single tool 9. The change of a tool 9 takes place within the operating cycle of the apparatus so that no standstill times result for the changing of a tool. Of course, it is possible also to change several tools 9 simultaneously if the length of the rail sections 18 and parts 12*a* of the guide rails 12 is correspondingly developed.

We claim:

1. In a device for the bending and/or distortion-free hardening of bar material, particularly leaf springs, having a plurality of frame-shaped tools each of which comprises an upper part and a lower part, the tools, upon closing, bending a heated workpiece and lowering the workpiece in clamped condition into a treatment tank, the tools being moved vertically in a portal for the bending and lowering and being discharged from the portal in a lowest position thereof and being transported by means of guide rails of a transport device through the treatment tank before the tools are grasped by a lift portal and raised into a position above the treatment tank, in which latter position the tools are opened, the workpiece is removed and the opened tools are transferred into a ready position, the improvement comprising upper guide rail means for returning opened tools including a movable part of the length of said upper guide rail means, said movable part corresponds at least to the axial depth of a tool, said movable part defining a normal position relative to the remainder of said upper guide rail means, said movable part being movable out of said normal position, changing means for being moved with said tool, means comprising rail sections arranged on said changing means and for replacing said movable part of said upper guide rail means.

2. The device according to claim 1, wherein said changing means comprises a changing frame means for moving horizontally between a ready position laterally alongside of the treatment tank and a working position above the treatment tank, said changing frame means carries said rail sections, the tools being adapted to be disposed on said rail sections during a change of the tools.

3. The device according to claim 2, wherein said movable part of said upper guide rail means is displacable laterally in a direction of motion of said changing frame means.

4. The device according to claim 2, wherein said upper guide rail means constitutes upper guide rails each having said movable part, respectively, disposed above the treatment tank, at least one of said movable parts of said upper guide rails is fastened to said changing frame means and is moveable horizontally together with said changing frame means.

5. The device according to claim 4, further comprising means for moving another of said movable parts.

* * * * *